US011434785B2

(12) United States Patent
Feldmann

(10) Patent No.: US 11,434,785 B2
(45) Date of Patent: Sep. 6, 2022

(54) JACKET RING ASSEMBLY FOR A TURBOMACHINE

(71) Applicant: MTU Aero Engines AG, Munich (DE)

(72) Inventor: Manfred Feldmann, Eichenau (DE)

(73) Assignee: MTU Aero Engines AG, Munich (DE)

( * ) Notice: Subject to any disclaimer, the term of this patent is extended or adjusted under 35 U.S.C. 154(b) by 316 days.

(21) Appl. No.: 16/453,232

(22) Filed: Jun. 26, 2019

(65) Prior Publication Data

US 2020/0003076 A1 Jan. 2, 2020

(30) Foreign Application Priority Data

Jun. 28, 2018 (DE) ..... 102018210600.2

(51) Int. Cl.

| | |
|---|---|
| ***F01D 25/24*** | (2006.01) |
| ***F01D 11/18*** | (2006.01) |
| *F01D 11/00* | (2006.01) |
| *F01D 11/08* | (2006.01) |

(52) U.S. Cl.

CPC ..... *F01D 25/24* (2013.01); *F01D 11/18* (2013.01); *F01D 11/005* (2013.01); *F01D 11/08* (2013.01); *F01D 25/246* (2013.01); *F05B 2240/11* (2013.01); *F05D 2260/941* (2013.01)

(58) Field of Classification Search

CPC ..... F01D 25/24; F01D 25/246; F01D 25/28; F01D 11/00; F01D 11/001; F01D 11/005; F01D 11/08; F01D 11/12; F01D 11/127

See application file for complete search history.

(56) References Cited

U.S. PATENT DOCUMENTS

| | | | | |
|---|---|---|---|---|
| 3,728,041 A | | 4/1973 | Bertelson | |
| 3,892,497 A | * | 7/1975 | Gunderlock | F01D 9/042 415/134 |
| 4,337,016 A | * | 6/1982 | Chaplin | F01D 11/24 415/116 |
| 4,925,365 A | * | 5/1990 | Crozet | F01D 9/04 277/415 |

(Continued)

FOREIGN PATENT DOCUMENTS

| | | |
|---|---|---|
| DE | 2232151 A1 | 4/1973 |
| DE | 10122464 C1 | 3/2002 |

(Continued)

*Primary Examiner* — Woody A Lee, Jr.
*Assistant Examiner* — Behnoush Haghighian
(74) *Attorney, Agent, or Firm* — Davidson, Davidson & Kappel, LLC

(57) ABSTRACT

A jacket ring assembly for a turbomachine, the jacket ring assembly including a casing part, a jacket ring segment which is adapted to radially outwardly surround a rotor blade ring and to this end is disposed radially inwardly of the casing part, as considered with respect to a longitudinal axis of the turbomachine, and a segmented ring which is circumferentially divided into segments and by which the jacket ring segment is mounted to the casing part, the segmented ring being axially form-fittingly disposed on a form-fitting element of the casing part, for which purpose each of the respective segments of the segmented ring is radially outwardly assembled with the form-fitting element, and the segmented ring forming a supporting seat on which the jacket ring segment is seated and radially inwardly supported with an axially forward end.

19 Claims, 4 Drawing Sheets

(56) References Cited

U.S. PATENT DOCUMENTS 5,387,082 A * 2/1995 Matyscak ..... F01D 11/005 415/139
5,513,857 A * 5/1996 Watanabe ..... F16J 9/145 277/469
6,439,844 B1 * 8/2002 Turnquist ..... F01D 5/225 415/173.3
6,808,363 B2 10/2004 Darkins, Jr. et al.
6,893,214 B2 * 5/2005 Alford ..... F01D 9/04 415/138
6,902,371 B2 * 6/2005 Anderson, Jr. ..... F01D 25/14 415/115
6,966,752 B2 * 11/2005 Gieg ..... F01D 11/127 415/173.4
7,229,246 B2 * 6/2007 Ghasripoor ..... F01D 11/16 415/173.3
7,866,943 B2 * 1/2011 Durand ..... F01D 11/12 415/173.1
8,128,343 B2 * 3/2012 Schiavo ..... F01D 11/005 415/116
8,206,092 B2 * 6/2012 Tholen ..... F01D 11/08 415/173.1
8,454,024 B2 * 6/2013 Kakehi ..... F16J 15/441 277/496
8,944,756 B2 * 2/2015 Lagueux ..... F01D 11/08 415/173.2
9,115,596 B2 * 8/2015 Clouse ..... F01D 11/125
9,127,569 B2 * 9/2015 Akiyama ..... F01D 11/24
9,416,676 B2 * 8/2016 Gieg ..... F01D 25/24
9,458,726 B2 * 10/2016 Lamusga ..... F01D 5/225
9,506,367 B2 * 11/2016 Clouse ..... F01D 25/246
9,506,368 B2 * 11/2016 Feldmann ..... F01D 25/246
9,664,065 B2 * 5/2017 Feldmann ..... F01D 25/246
9,759,231 B2 * 9/2017 Kirchner ..... F01D 25/246
9,803,491 B2 * 10/2017 Clouse ..... F01D 11/005
9,982,566 B2 * 5/2018 Gieg ..... F01D 25/183
10,047,618 B2 * 8/2018 Hess ..... F01D 25/24
10,060,531 B2 * 8/2018 Mayer ..... F16J 15/3272
10,196,911 B2 * 2/2019 Jenkins ..... F01D 25/246
10,428,689 B2 * 10/2019 Schmidt ..... F01D 9/04
10,954,807 B2 * 3/2021 Usseglio ..... F01D 11/003
2004/0071548 A1 * 4/2004 Wilson, Jr. ..... F01D 11/18 415/173.1
2004/0120808 A1 * 6/2004 Alford ..... F01D 9/04 415/173.1
2004/0213666 A1 * 10/2004 Gieg ..... F01D 25/246 415/170.1
2016/0153306 A1 * 6/2016 Romanov ..... F02C 7/20 60/796
2016/0245102 A1 * 8/2016 Freeman ..... F01D 11/08
2017/0089211 A1 * 3/2017 Broomer ..... F01D 11/005
2017/0159492 A1 6/2017 Kufner et al.
2017/0350265 A1 * 12/2017 McLaughlin ..... F01D 25/12
2018/0087394 A1 * 3/2018 Sarawate ..... F16J 15/0806
2019/0323370 A1 * 10/2019 Trivedi ..... F16J 15/3488
2020/0063578 A1 * 2/2020 Notarnicola ..... F01D 9/04

FOREIGN PATENT DOCUMENTS

EP 1431515 A2 6/2004
EP 1431518 A2 6/2004
EP 2857639 A1 4/2015
EP 2971590 B1 5/2017
EP 3179053 A1 6/2017
WO WO2009042069 A2 4/2009
WO WO2012041651 A1 4/2012

* cited by examiner

JACKET RING ASSEMBLY FOR A TURBOMACHINE

TECHNICAL FIELD

The present invention relates to a jacket ring assembly for a turbomachine.

BACKGROUND INFORMATION

The turbomachine may be, for example, a jet engine, such as a turbofan engine. The turbomachine is functionally divided into a compressor, a combustor and a turbine. In the case of the jet engine, for example, intake air is compressed by the compressor and mixed and burned with jet fuel in the downstream combustor. The resulting hot gas, a mixture of combustion gas and air, flows through the downstream turbine and is expanded therein. The turbine is typically divided into several modules; i.e., it may include, for example, a high-pressure turbine module and a low-pressure turbine module. Each of the turbine modules typically includes a plurality of stages, each stage being composed of a stator vane ring and a rotor blade ring downstream thereof.

The jacket ring assembly in question includes a casing part and a jacket ring segment mounted radially inwardly on the casing part. In a fully assembled module, the jacket ring segment radially outwardly bounds the gas duct, namely at the axial position of a rotor blade ring. Accordingly, the jacket ring segment may be provided, for example, with a sealing system or an abradable coating along which the rotor blades of the ring rub with their outer shrouds. Like the reference to a jet engine, for example, this is intended to illustrate the present subject matter, but initially not to limit the generality thereof.

SUMMARY OF THE INVENTION

It is an object of the present invention to provide a particularly advantageous jacket ring assembly.

The present invention provides a jacket ring assembly. More specifically, the subject matter relates to the attachment or mounting of the jacket ring segment to the casing part, which is accomplished with a segmented ring. This segmented ring is assembled from radially inside with a form-fitting element of the casing part. To this end, the segmented ring is circumferentially divided into a plurality of segments which can be handled individually, and thus can be successively assembled from inside radially outward with the form-fitting element of the casing part. The fully assembled segmented ring is axially form-fittingly retained on the casing part.

The segmented ring further forms a supporting seat on which the jacket ring segment is seated and thus radially inwardly supported. Compared to a conceivable alternative design approach, namely a jacket ring segment which rests directly on a casing hook of the casing part itself, the approach according to the present invention can be advantageous first of all for thermal reasons. In particular, the shielding of the casing can be improved and, moreover, the supporting seat of the jacket ring segment can be better sealed toward the gas duct. Furthermore, in an approach using a "casing hook," relatively high temperature gradients would occur at the casing hook or in the casing, which may limit service life.

As an alternative to the present subject matter, the jacket ring segment could itself be provided at its forward end with a suspension element which would be form-fittingly mounted on the casing part instead of the segmented ring. However, this may be disadvantageous inasmuch as the jacket ring segment would have to be provided as a cast part of suitable thickness in order to create a sufficiently sturdy suspension element. In the present case, however, the jacket ring segment may preferably be formed as a sheet-metal part (see below), which provides cost and weight advantages. Because of the greater weight, a cast part is also limited in its extent in the circumferential direction; i.e., there would be a greater number of joints around the entire circumference (heating in the narrow gaps). Furthermore, a jacket ring segment having an integral suspension element is also relatively complex and costly, which can be disadvantageous in terms of manufacture and also maintenance.

The jacket ring segment may be provided with at an abradable seal into which the rotor blades or the outer sealing fins thereof can rub.

Preferred embodiments will be apparent from the entire description. In the description of the features, a distinction is not always drawn specifically between device, method and use aspects. In any case, the disclosure should be read to imply all claim categories. In particular, it always relates to both the jacket ring assembly and a module or turbine module having such a jacket ring assembly, as well as to corresponding uses.

In the context of the present disclosure, "axial" generally relates to the longitudinal axis of the turbine module, and thus to the longitudinal axis of the turbomachine, which coincides, for example, with an axis of rotation of the rotors. "Radial" refers to the radial directions that are perpendicular thereto and point away therefrom; and a "circumference," respectively "circumferential" or the "circumferential direction" relate to the rotation about the longitudinal axis. "Forward" and "rearward" relate to the axial component of the direction of flow of the hot gas. Thus, the hot gas axially passes "forward" components before it passes "rearward" components. In the context of the present disclosure, "a" and "an" are to be read as indefinite articles and thus always also as "at least one," unless expressly stated otherwise.

The jacket ring segment bears with its axially forward end on the segmented ring, and, with its axially rear end, it preferably rests on the outer shroud of the stator vane ring downstream thereof. During initial manufacture, a module is usually built up from an axially forward end to an axially rearward end; which in the present case means, for example, that initially the segmented ring can be mounted to the casing part, and subsequently the jacket ring segment can be put into place. In the present case, it is a particular advantage that the segmented ring also allows for installation and removal from an axially forward end. This may be advantageous in particular during an overhaul of the turbomachine (see below for more details).

The segmented ring; i.e., its segments, may be produced, for example, by turning and milling from a forged ring. However, the segments may also be cast parts (in conjunction with subsequent machining of the functional surfaces). Finally, additive manufacturing may also be used; i.e., the segmented ring or the segments may be additively built up layer by layer from a previously amorphous or shape-neutral material. When viewed in an axial section, the segmented ring may form, for example, as an inverted T-shape at its radially inner end. Its inner circumferential surface may preferably provide a seal against an axially upstream gas duct component. For example, it may form a piston ring sliding surface.

The assembled segmented ring is axially form-fittingly retained on the form-fitting element. To this end, the form-fitting element of the casing part may be, for example, a radially inwardly open groove into which the segmented ring extends with a radially outwardly projecting web.

In a preferred embodiment, the arrangement is exactly the opposite; i.e., the form-fitting element of the casing part is a radially inwardly projecting web that is seated in a radially outwardly open receptacle of the segmented ring. The individual segments of the segmented ring are radially outwardly slid onto the web of the casing part. When viewed in axial sections, the segments may each be U-shaped in a radially outer portion; the U-shape is slid onto the web.

In a preferred embodiment, when viewed in an axial section, the web of the casing part extends at an angle of no more than 30°, and further preferably at least 20° or 10°, to the radial direction. Considered here is the smaller of two angles that a straight line drawn in the web forms with in the radial direction in the axial section. Preferably, when viewed in the axial section, the web is perpendicular to the longitudinal axis; i.e., the angle is 0°. This may simplify the design and also the assembly, although, in general, assembly from inside is still possible with an oblique web as long as the assembly clearance and the elasticity of the segments allow for bridging of undercuts (which may be formed with increasing angle).

In a preferred embodiment, a retaining ring is provided on which the segments of the segmented ring are seated and supported radially inwardly. The retaining ring presses the segments radially outwardly into engagement with the form-fitting element. To this end, the retaining ring may extend uninterruptedly in the circumferential direction. As an alternative to a retaining ring, it is generally also conceivable to radially secure the segments with or via a casing part; i.e., for example, an axially upstream casing part could suitably fix the segments in position.

In a preferred embodiment, the retaining ring, which is circumferentially closed (uninterruptedly continuous), is axially pressed into a receptacle in the segmented ring. With regard to the preferred capability of installation and removal from an axially forward end, the receptacle preferably faces forwardly; i.e., the retaining ring is axially rearwardly pressed into place. The retaining ring is retained in the receptacle by a press fit.

In a preferred embodiment, at the receptacle, the segmented ring forms a radially projecting projection behind which the retaining ring is axially form-fittingly retained. Preferably, this projection is formed on a radially inwardly facing inner wall surface of the segmented ring, against which rests the inserted retaining ring with an outer wall surface. The projection is so dimensioned that the retaining ring can be axially pressed into place, but is then secured in the axially opposite direction. Preferably, this is assisted by a beveled face (saw-tooth profile) along which the retaining ring slides as it is pressed into place.

In a preferred embodiment, the jacket ring segment is a sheet-metal part, which may be advantageous from a cost perspective (initial manufacture and also maintenance), but also in terms of weight. The sheet-metal part may have a seal, such as one known as honeycomb seal, attached (e.g., brazed) to the radially inner side thereof. However, a sheet-metal part is generally not mandatory, and many of the aforementioned advantages (e.g., capability of installation "from the front"), can also be achieved using an additively manufactured jacket ring segment or one produced as a cast part.

The embodiments described below relate to the orientation or extension of the abutting faces with which the segments of the segmented ring meet circumferentially. Two immediately circumferentially adjacent segments have complementary abutting faces at a respective joint.

In a preferred embodiment, at least one of the segments has abutting faces which are parallel to each other when viewed in the axial direction. During assembly of the segmented ring; i.e., when the individual segments are radially outwardly inserted one after the other, the segment having the mutually parallel abutting faces can be inserted or slid into place even when the immediately circumferentially adjacent segments are already in their installed positions. The segment can be inserted along an insertion direction parallel to its abutting faces. The segment is moved in the insertion direction into its position in the segmented ring. Considered with respect to the segmented ring as a whole, the mutually parallel abutting faces are preferably oriented in such a way they or their projections toward the opposite side of the segmented ring frame the center of the segmented ring centrally therebetween.

In a preferred embodiment, every other segment in the circumferential direction has two mutually parallel abutting faces. Preferably, the segments having the mutually parallel abutting faces are identical in construction among themselves, and the complementary segments interposed therebetween are also identical in construction among themselves, so that the entire segmented ring can be built using only two different types of segments.

In another preferred embodiment, the segment(s) is or are mounted in such a way that the segmented ring can ideally be built from only one type of segment. This can be accomplished with an abutting face that is oriented obliquely to the radial direction when viewed in the axial direction. Specifically, the oblique abutting face forms an angle $\alpha$ of at least 85° and no more than 110° with a connecting line extending diagonally through the segment to the outer corner of the oblique abutting face. Further preferred upper limits are no more than 100° or 95°; further preferred lower limits (independent of the upper limits) are at least 88° or 90° (with increasing preference in the respective order of mention). By suitably limiting the angle $\alpha$, the segment can be inserted even when the immediately circumferentially adjacent segments are already in their installed positions. To this end, the segment can initially be placed in position with its opposite abutting face and then, as it were, rotated into engagement with the oblique abutting face (see FIG. 4 for illustration).

In a preferred embodiment, all segments are identical in construction, and thus rotationally symmetric about the longitudinal axis. The storage and installation of only one type of segment may simplify assembly and warehousing.

In a preferred embodiment, a sealing insert, preferably a sealing plate, is inserted at a joint where two segments meet with their abutting faces. To this end, a pocket which is open toward the joint is formed in each of these two segments; the sealing insert is axially retained therein and extends across the joint. In order to allow these segments to nevertheless be assembled from radially inside, one of the pockets is preferably radially outwardly open. During assembly, the sealing insert is placed in the other pocket, which is closed both radially inwardly and radially outwardly, and then slides into the radially outwardly open pocket as the other segment is moved into position.

The present invention also relates to a turbine module having a jacket ring assembly as disclosed herein. A rotor blade ring is disposed radially inwardly of the jacket ring segment. Preferably, the turbine module has an axially downstream stator vane ring on whose outer shroud the jacket ring segment is seated (and radially inwardly supported) with its axially rear end. The jacket ring assembly including the jacket ring segment is preferably part of the axially forwardmost stage of the module because this allows removal from an axially forward end. Of course, it is also possible that other stages or all stages of the turbine module are provided with a jacket ring assembly according to the present invention.

The present invention also relates to a method for overhauling a corresponding turbine module, in which the jacket ring segment is removed by dismantling the segmented ring from an axially forward end. The individual modules (high-pressure or low-pressure, etc.) of the turbine can be relatively easily separated from one another, whereby each module is accessible from an axially forward end and from an axially rearward end. Accessibility from an axially forward end can be advantageous inasmuch as axially forward components can be more heavily stressed.

The present invention also relates to the use of a corresponding turbine module or a jacket ring assembly as disclosed herein in a turbomachine, in particular in a jet engine, such as, for example, a turbofan engine.

BRIEF DESCRIPTION OF THE DRAWINGS

The present invention will now be explained in more detail with reference to an exemplary embodiment. The individual features may also be essential to the invention in other combinations within the scope of the other independent claims, and, as above, no distinction is specifically made between different claim categories.

In the drawings.

DETAILED DESCRIPTION

Figure 1:
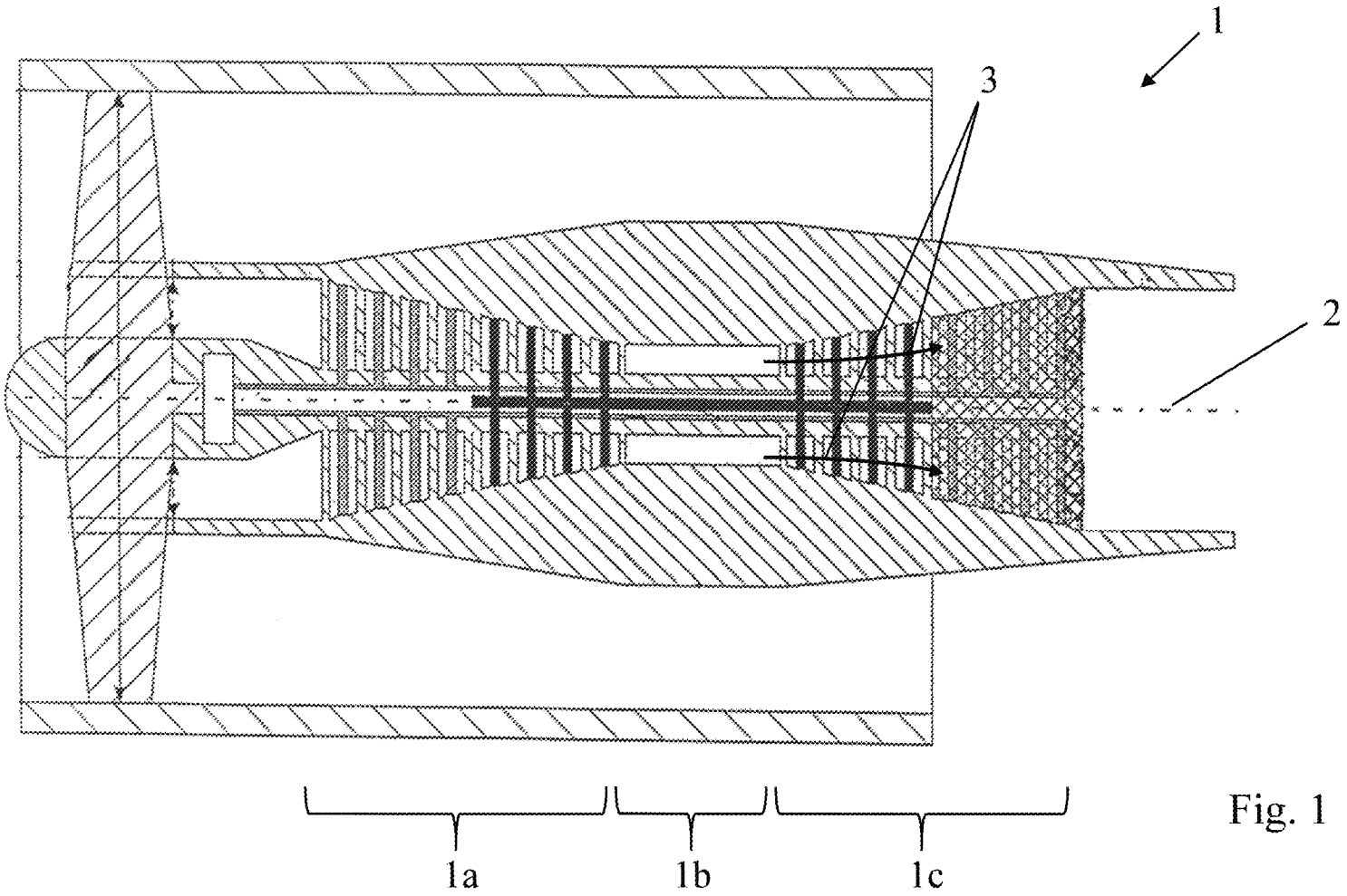
FIG. 1 shows an axial cross-sectional view of a turbofan engine.

FIG. 1 shows in axial section a turbomachine 1, specifically a turbofan engine. Turbomachine 1 is functionally divided into a compressor 1*a*, a combustor 1*b* and a turbine 1*c*. Both compressor 1*a* and turbine 1*c* are made up of a plurality of stages, each stage being composed of a stator vane ring and a subsequent rotor blade ring. During operation, the rotor blade rings rotate about longitudinal axis 2 of turbomachine 1. The intake air is compressed in compressor 1*a*, and is then mixed and burned with jet fuel in the downstream combustor 1*b*. The hot gas flows through hot gas duct 3, thereby driving the rotor blade rings that rotate about longitudinal axis 2.

Figure 2:
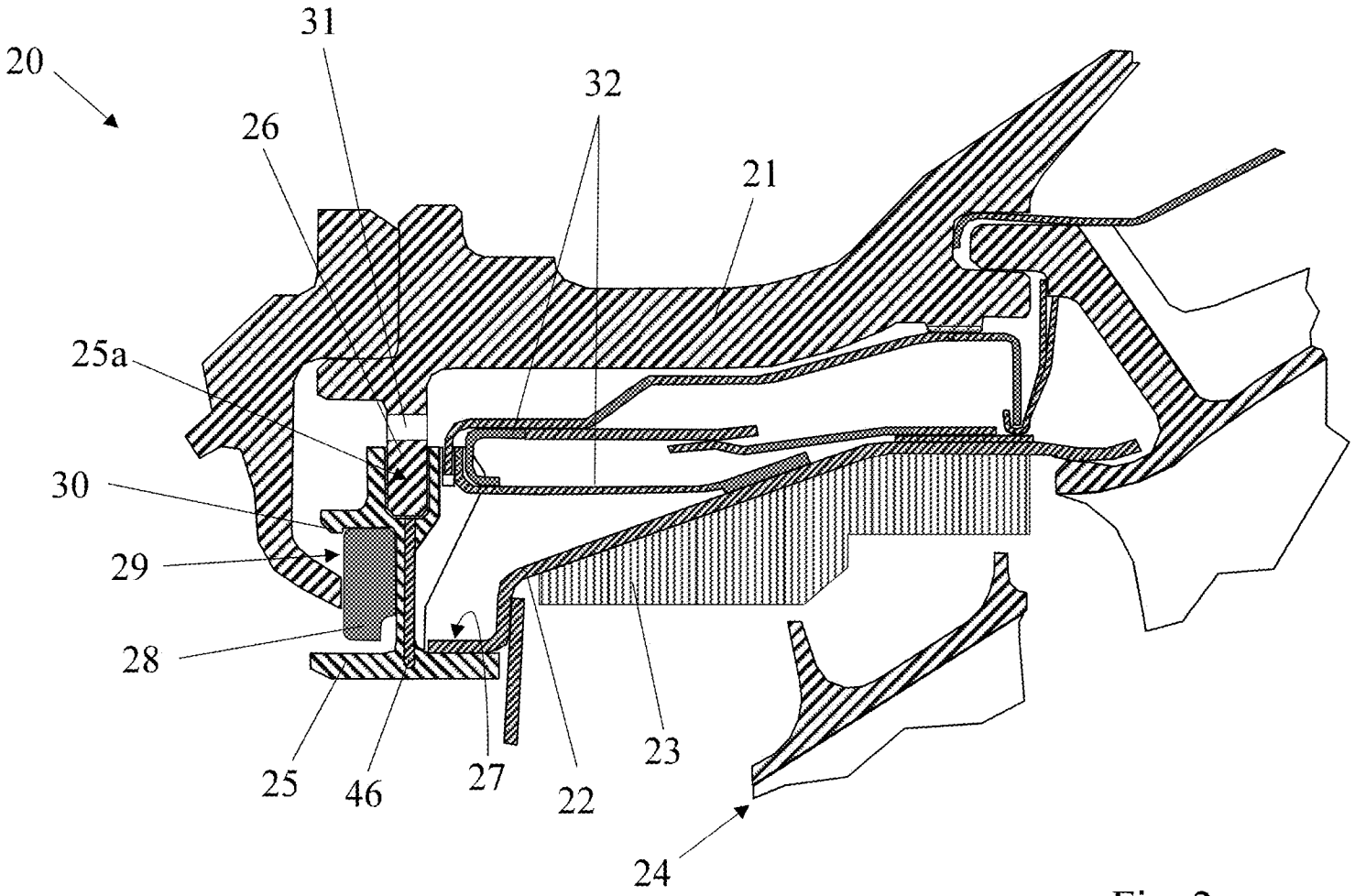
FIG. 2 shows an axial cross-sectional view of an inventive jacket ring assembly as part of the turbofan engine of FIG. 1.

FIG. 2 shows a jacket ring assembly 20 provided as part of a module of turbine 1*c*. It has a casing part 21 and a jacket ring segment 22 having a seal 23, here an abradable coating in the form of a honeycomb seal, disposed on the radially inner side thereof. Jacket ring segment 22 radially outwardly surrounds rotor blades 24.

Figure 3:
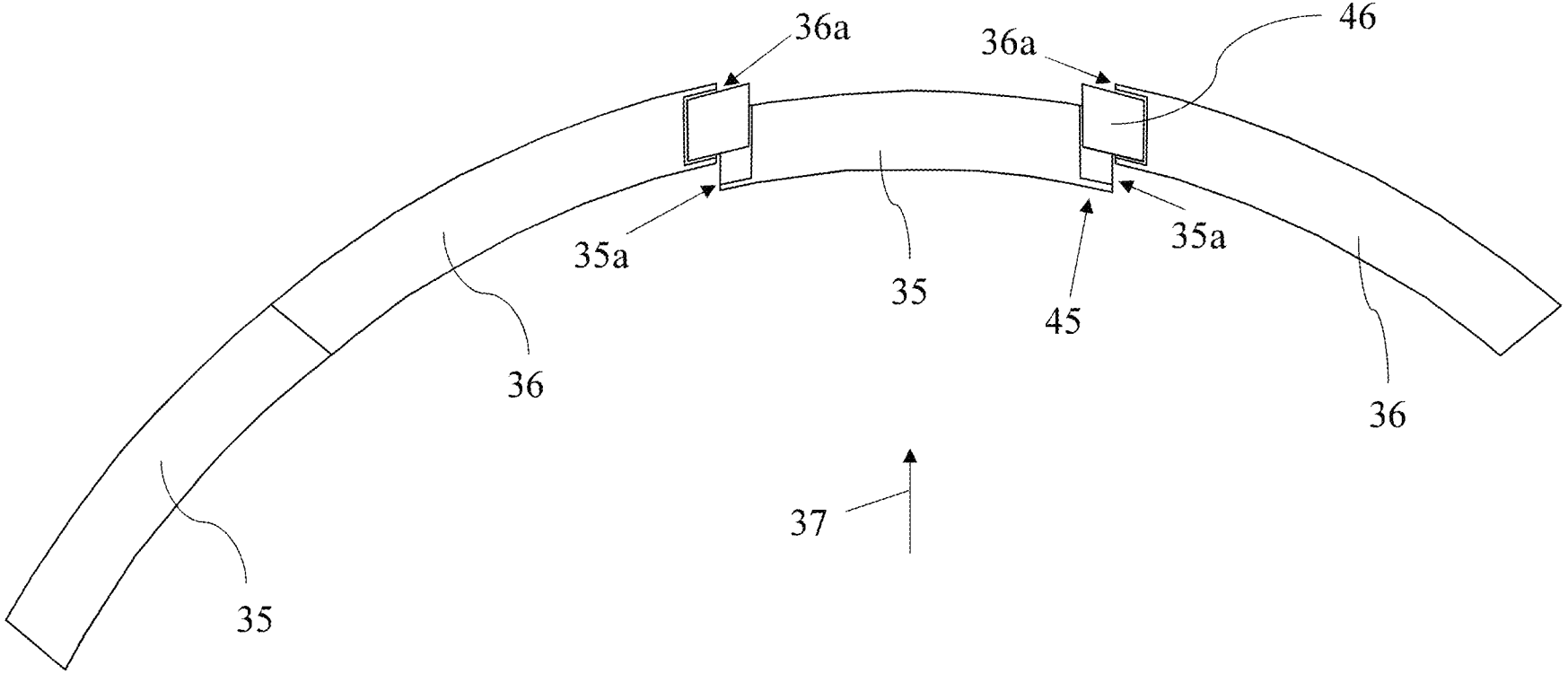
FIG. 3 shows a portion of a segmented ring of the assembly of FIG. 2 in a cross-sectional view taken perpendicular to the axial direction.
Figure 4:
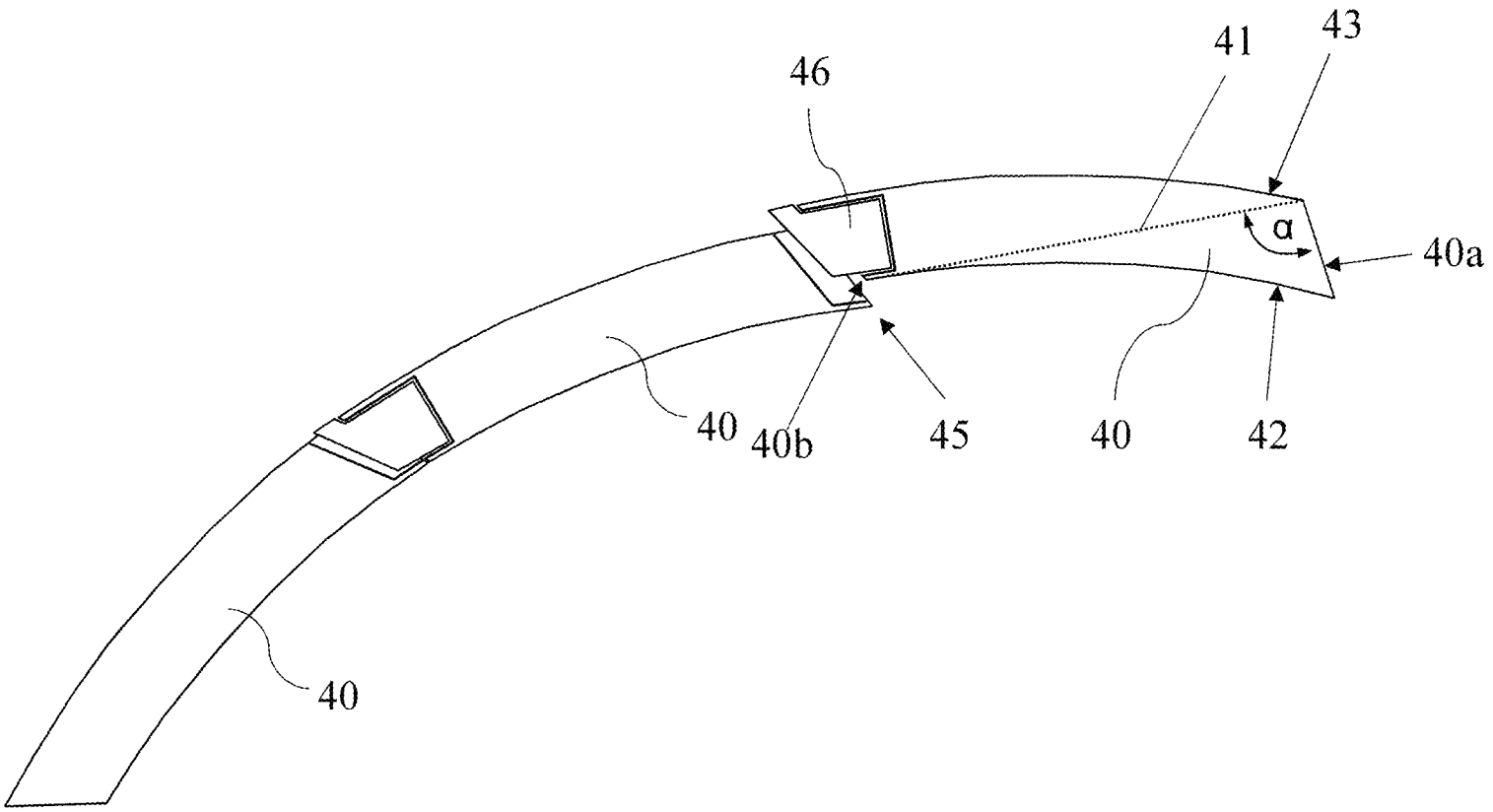
FIG. 4 shows, as an alternative to FIG. 3, a further option for the orientation of the abutting faces of the individual segments.

In order to mount jacket ring segment 22 on casing part 21, a segmented ring 25 is provided which is circumferentially divided into a plurality of segments (see FIGS. 3 and 4). The individual segments of segmented ring 25 are assembled from radially inside with a form-fitting element 26 of casing part 21. In the present case, form-fitting element 26 is provided as a radially inwardly projecting web of the casing, onto which the segments of segmented ring 25 are slid until the web of the casing comes radially into engagement within a receptacle 25*a* of segmented ring 25. The segments of the segmented ring are then also axially form-fittingly retained. Segmented ring 25 forms a supporting seat 27 which radially inwardly supports jacket ring segment 22 at its axially forward end. A retaining ring 28 is inserted to retain the segments of segmented ring 25 radially in position. The retaining ring extends uninterruptedly in the circumferential direction and is axially pressed into a receptacle 29 of segmented ring 25. In receptacle 29, the retaining ring is axially form-fittingly retained behind a projection 30.

Form-fitting element 26; i.e., the web of casing part 21, is provided with a bore 31, which is optional and may be used to supply a cooling fluid. Furthermore, the shielding plates 32 disposed radially between casing part 21 and jacket ring segment 22 are also optional; the inventive approach could also be implemented with an insulating material or the like between casing part 21 and jacket ring segment 22.

FIG. 3 shows segmented ring 25 in a cross-sectional view taken perpendicular to longitudinal axis 2 (for the sake of clarity without hatching), and more specifically, a portion of the segmented ring including several segments 35, 36. At their circumferential ends, segments 35, 36 are provided with respective abutting faces 35*a*, 36*a* with which they meet. In the case of the assembly shown in FIG. 3, segmented ring 25 is built from two types of segments. On the one hand, there are segments 35 whose abutting faces 35*a* are parallel to each other in each segment 35. These segments 35 and the complementary segments 36 alternate with one another. Due to the mutually parallel abutting faces 35*a*, segments 35 can each be slid into their installed positions in an insertion direction 37 after the immediately adjacent segments 36 have been placed in position.

FIG. 4 shows segments 40 which are alternative to those shown in FIG. 3 and which allow the segmented ring 25 to be entirely built from only one type of segment. To this end, an abutting face 40*a* is oriented obliquely such that it forms an angle $\alpha$ of about 90° with a connecting line 41. The opposite abutting face 40*b* has a complementary oblique orientation; it forms an obtuse angle at an inner circumferential surface 42 of the segmented ring and an acute angle at outer circumferential surface 43. During insertion, when the immediately circumferentially adjacent segments 40 are already in their installed positions, a corresponding segment 40 can initially be hooked into place with its abutting face 40*b*. Subsequently, segment 40 is rotated into its installed position.

Regardless of the specific configuration of segments 35, 40, sealing inserts 46 are provided at the respective joints 45.

LIST OF REFERENCE NUMERALS

| | |
|---|---|
| turbomachine | 1 |
| compressor | 1a |
| combustor | 1b |
| turbine | 1c |
| longitudinal axis | 2 |
| hot gas duct | 3 |
| jacket ring assembly | 20 |
| casing part | 21 |
| jacket ring segment | 22 |
| seal | 23 |

-continued

| | |
|---|---|
| rotor blade | 24 |
| segmented ring | 25 |
| receptacle | 25a |
| form-fitting element | 26 |
| supporting seat | 27 |
| retaining ring | 28 |
| receptacle | 29 |
| projection | 30 |
| bore | 31 |
| shielding plates | 32 |
| segment | 35 |
| abutting face | 35a |
| segment | 36 |
| abutting face | 36a |
| segment | 40 |
| abutting faces | 40a, b |
| connecting line | 41 |
| inner circumferential surface | 42 |
| outer circumferential surface | 43 |

What is claimed is:

1. A jacket ring assembly for a turbomachine, comprising:

a casing part;

a jacket ring segment adapted to radially outwardly surround a rotor blade ring and disposed radially inwardly of the casing part, as considered with respect to a longitudinal axis of the turbomachine; and a segmented ring circumferentially divided into segments, the jacket ring segment mounted to the casing part by the segmented ring, the segmented ring being axially form-fittingly disposed on a form-fitting element of the casing part, so that each of the respective segments of the segmented ring is radially outwardly assemblable with the form-fitting element, the segmented ring forming a supporting seat, the jacket ring segment being seated on the supporting seat and radially inwardly supported with an axially forward end, wherein at least two of the segments of the segmented ring meet circumferentially at a pair of adjacent faces, the pair of the adjacent faces when viewed in an axial direction being angled with respect to the radial direction.

2. The jacket ring assembly as recited in claim 1 wherein the form-fitting element of the casing part is a radially inwardly projecting web disposed in a radially outwardly open receptacle of the segmented ring.

3. The jacket ring assembly as recited in claim 2 wherein when viewed in the axial direction, the web extends at an angle of no more than 30° in the radial direction.

4. The jacket ring assembly as recited in claim 1 further comprising a retaining ring pressing the segments of the segmented ring radially outwardly into engagement on the form-fitting element.

5. The jacket ring assembly as recited in claim 4 wherein the retaining ring is circumferentially closed and is axially pressed into a receptacle in the segmented ring.

6. The jacket ring assembly as recited in claim 5 wherein, when viewed in the axial direction, the retaining ring is axially form-fittingly retained in the receptacle behind a projection.

7. The jacket ring assembly as recited in claim 1 wherein the jacket ring segment is a sheet-metal part or wherein an abradable seal is disposed on the jacket ring segment.

8. The jacket ring assembly as recited in claim 1 wherein at least one segment of the segments has one adjacent face of the pair of adjacent faces and has an opposite face, the one adjacent face and the opposite face being parallel to each other when viewed in the axial direction, the opposite face thus also being angled with respect to the radial direction.

9. The jacket ring assembly as recited in claim 8 wherein a further segment of the segments has opposing faces parallel to each other when viewed in the axial direction.

10. The jacket ring assembly as recited in claim 1 wherein at least one of the adjacent faces is an oblique abutting face which, when viewed in the axial direction, forms an angle $\alpha$ of at least 85° and no more than 110° with a connecting line extending between a point of intersection of the oblique abutting face with an outer periphery of the segmented ring and a point of intersection of an opposite abutting face with an inner periphery of the segmented ring.

11. The jacket ring assembly as recited in claim 10 wherein all segments of the segmented ring are identical in construction.

12. The jacket ring assembly as recited in claim 1 further comprising a sealing insert disposed at a joint where the at least two segments meet.

13. A turbine module having the jacket ring assembly as recited in claim 1 and a rotor blade ring radially outwardly surrounded by the jacket ring segment.

14. The turbine module as recited in claim 13 wherein the jacket ring assembly is part of an axially forward stage of the turbine module.

15. A method for overhauling a turbine module according to claim 13 wherein the jacket ring segment is removed by dismantling the segmented ring from an axially forward end.

16. A turbomachine comprising the jacket ring assembly as recited in claim 1.

17. A jet engine comprising the turbomachine as recited in claim 16.

18. The jacket ring assembly as recited in claim 1 wherein the two segments are different in construction.

19. The jacket ring assembly as recited in claim 9 wherein between the at least one segment and the further segment is a yet further segment with further opposing faces that are not parallel to each other.

* * * * *